US005649519A

United States Patent [19]

Linderman

[11] Patent Number: 5,649,519

[45] Date of Patent: Jul. 22, 1997

[54] APPARATUS FOR PROPELLING PROJECTILES

[76] Inventor: Herman L. Linderman, 4313 Rio-Tinto Ave., Sacramento, Calif. 95821

[21] Appl. No.: 654,566

[22] Filed: May 29, 1996

[51] Int. Cl.[6] ..... F41B 5/00

[52] U.S. Cl. ..... 124/23.1; 124/24.1

[58] Field of Search ..... 124/20.1, 20.3, 124/23.1, 24.1, 25, 25.6, 86, 88

[56] References Cited

U.S. PATENT DOCUMENTS

| | | | |
|---|---|---|---|
| 2,186,386 | 1/1940 | Lowell | 124/24.1 |
| 3,265,055 | 8/1966 | Gage | 124/24.1 |
| 3,561,418 | 2/1971 | Fredrickson | 124/24.1 |
| 3,630,186 | 12/1971 | Babyn | 124/23.1 |
| 3,855,991 | 12/1974 | Imatt et al. | 124/24.1 |
| 4,759,337 | 7/1988 | Suski | 124/24.1 |
| 5,277,169 | 1/1994 | Magnuson | 124/20.1 |

*Primary Examiner*—John A. Ricci
*Attorney, Agent, or Firm*—Thomas R. Lampe

[57] ABSTRACT

Apparatus for propelling arrows and other types of projectiles includes an elongated, flexible bow member having opposed ends. Two spaced bowstrings are attached to the ends of the bow member and extend under tension between the opposed ends. A plurality of projectile propelling elements frictionally engage the bowstrings and are slidably movable relative thereto. The center of the bow member has an opening formed therein through which the user of the apparatus propels a projectile from a selected propelling element.

15 Claims, 2 Drawing Sheets

APPARATUS FOR PROPELLING PROJECTILES

TECHNICAL FIELD

This invention relates to apparatus for propelling projectiles. More particularly, the invention incorporates an elongated, flexible bow member to project arrows and other projectiles.

BACKGROUND ART

Bows have been utilized for centuries to propel arrows. Slingshots and other types of devices have been employed for centuries to propel other types of projectiles such as rocks. Conventional archery bow and string combinations are unsuitable for propelling or projecting projectiles other than arrows or arrow-like projectiles such as darts. Likewise, conventional slingshot arrangements and similar devices are unsuitable for accurately propelling arrows.

DISCLOSURE OF INVENTION

The present invention relates to apparatus for propelling projectiles of different types, including, for example, arrows, rocks, ball bearings and other projectiles.

The apparatus includes an elongated, flexible bow member having opposed ends.

A first bowstring is attached to the bow member and extends under tension between the opposed ends of the bow member.

A second bowstring is attached to the bow member and extends under tension between the opposed ends of the bow member. The first and second bowstrings are spaced apart between the opposed ends of the bow member.

At least one manually graspable propelling element extends between the bowstrings for engaging a projectile and propelling the projectile away from the bow member.

In the arrangement disclosed herein a plurality of manually graspable propelling elements extend between the bowstrings. The manually graspable propelling elements frictionally engage both of the bowstrings and are slidably movable relative to the bow strings to allow the manually graspable propelling elements to be selectively positioned at different locations along the bowstrings.

Other features, advantages, and objects of the present invention will become apparent with reference to the following description and accompanying drawings.

BEST MODE FOR CARRYING OUT THE INVENTION

Figure 1:
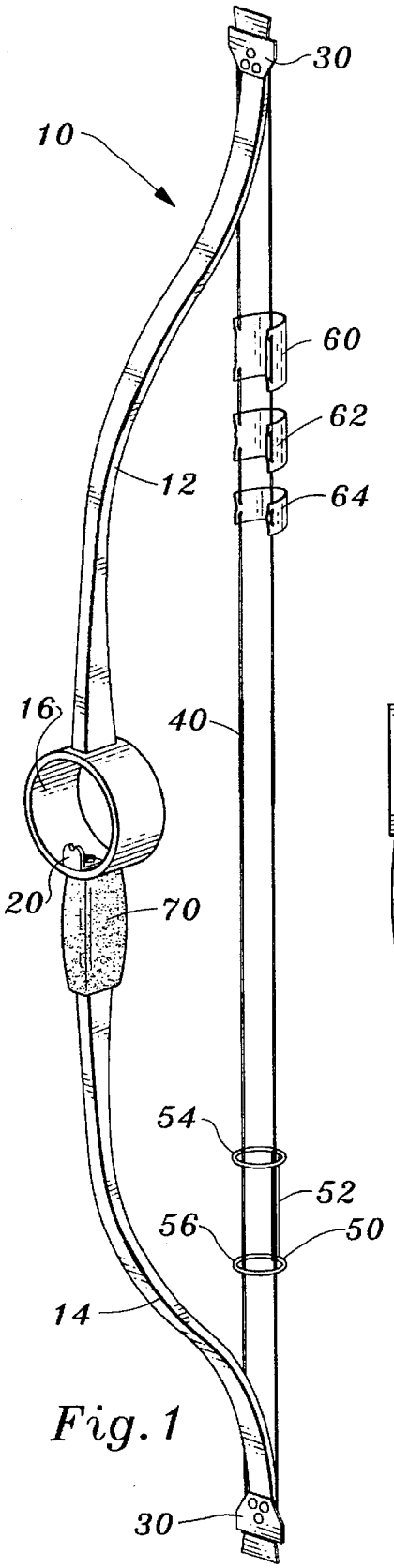
FIG. 1 is a perspective view of apparatus constructed in accordance with the teachings of the present invention.
Figure 2:
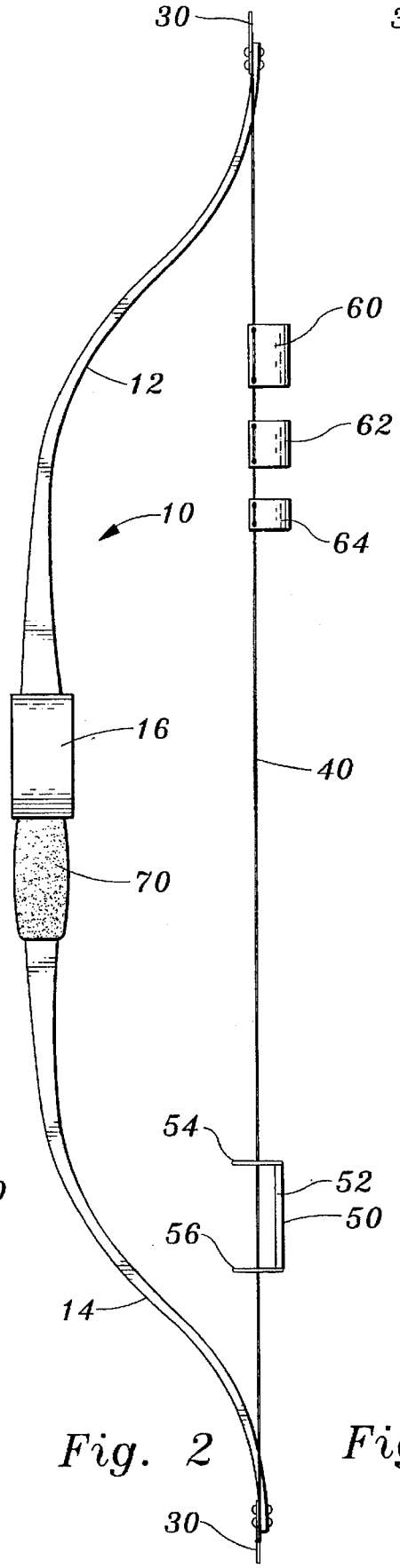
FIG. 2 is a right side view of the apparatus.
Figure 3:
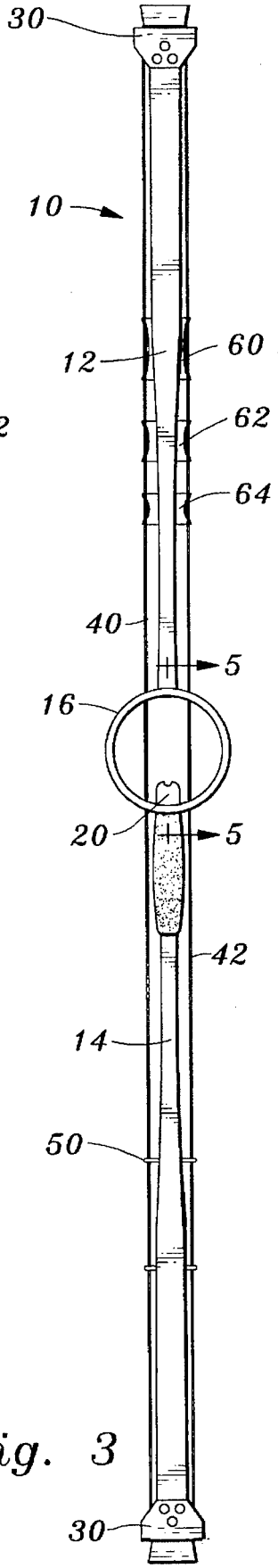
FIG. 3 is a front elevational view of the apparatus.

Referring now to the drawings, the apparatus of the present invention includes an elongated, flexible bow member generally designated by reference numeral 10.

Bow member 10 includes a flexible elongated bow segment 12, a flexible elongated bow segment 14 and a bow segment connector 16 between the bow segments and attached to the bow segments. The bow segments and bow segment connector may be formed of any suitable material and any conventional means may be employed to secure the bow segments and bow segment connector together.

Bow segment connector 16 is in the form of a ring, the continuous connector wall thereof extending about and defining a large circular opening.

FIGS. 1, 3, 4 and 5 show an arrow support 20 connected to the bow segment connector 16 by a screw fastener 22 threadedly engaged with the bow segment connector. Arrow support 20 includes an upwardly extending leg 24 having a notch 26 formed at the upper end thereof. The notch is for slidably receiving and supporting the shaft of an arrow such as arrow 28 shown in FIG. 4. The leg 24 extends a relatively short distance into the opening defined by bow segment connector 16. In the arrangement illustrated, a peg 31 affixed to the arrow support and extending downwardly therefrom fits into a correspondingly shaped recess located at the bottom of the bow segment connector to maintain the arrow support in the desired position relative to the bow segment connector.

Attached at the distal ends of bow segments 12, 14 by any suitable fasteners such as rivets, screws or the like are plates 30 of identical construction. The plates 30 define recesses at the ends of the bow member which receive and accommodate the ends of a continuous loop of bowstring. The term bowstring as utilized herein is meant to encompass any material suitable for use as a bowstring including but not necessarily limited to woven or unwoven strand material, wires, ropes, cables, etc.

The bowstring loop includes two bowstrings 40, 42 which extend under tension between the opposed ends of the bow member. The bowstrings 40, 42 are spaced apart and are generally parallel.

Figure 4:
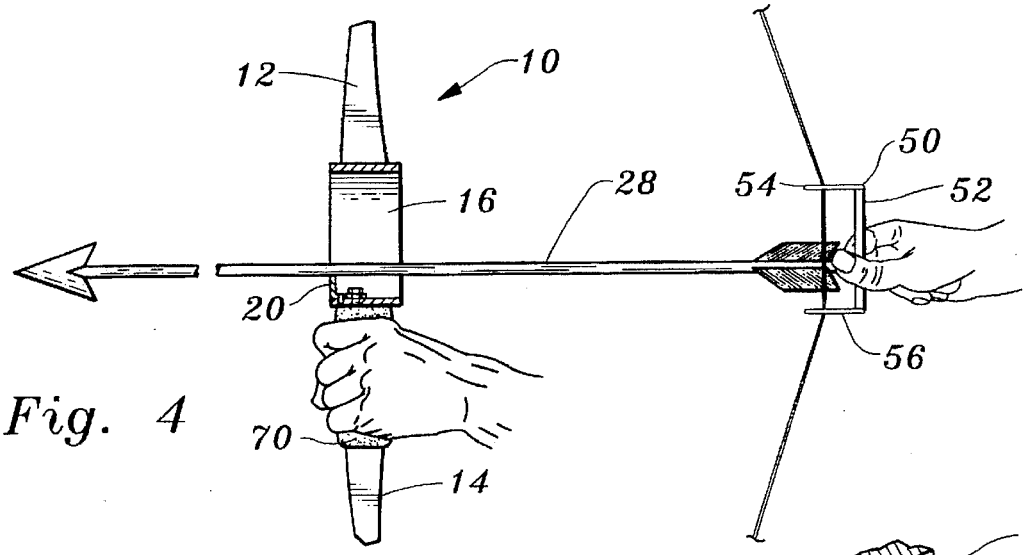
FIG. 4 is a side view in partial cross section showing a selected portion of the apparatus when the apparatus is employed to propel an arrow.
Figure 5:
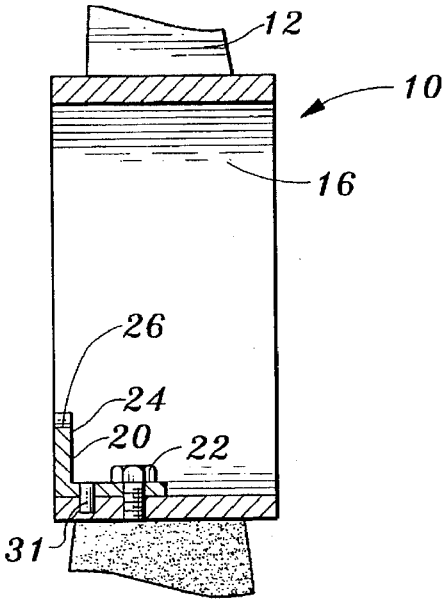
FIG. 5 is a greatly enlarged view illustrating the bow segment connector of the apparatus in cross section along with selected portions of cooperable structure, including an arrow support also shown in cross section.
Figure 6:
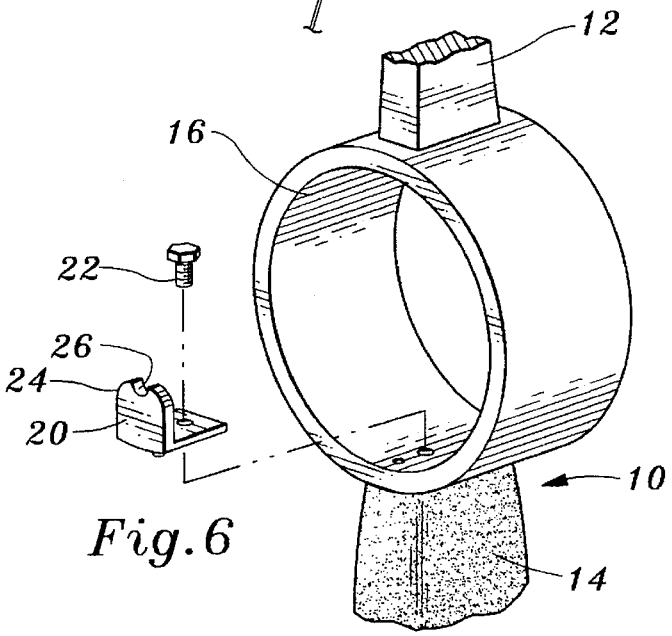
FIG. 6 is an exploded view of the structural components shown in FIG. 5.
Figure 7:
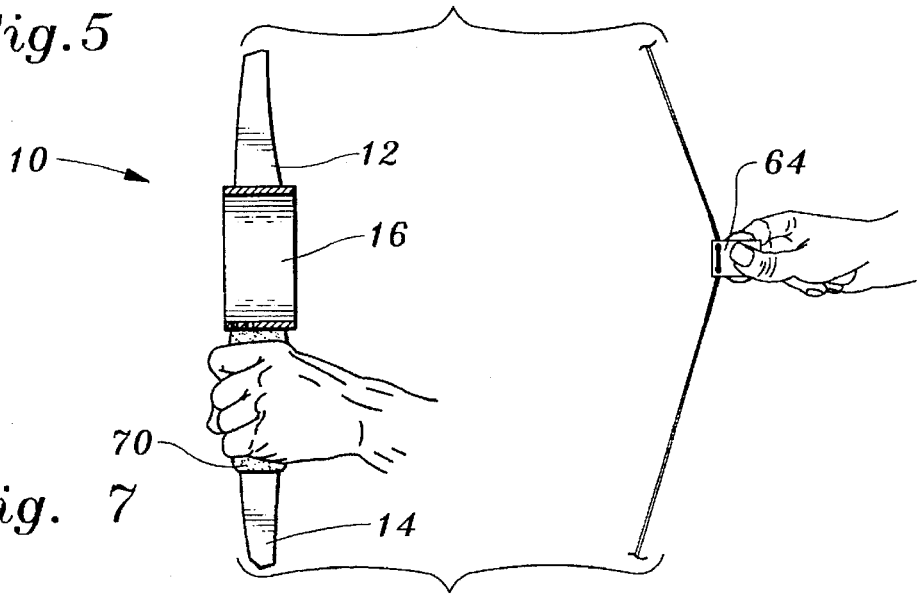
FIG. 7 is a view similar to FIG. 4 but illustrating the apparatus being employed to propel a rock.

Frictionally engaging and selectively slidable positionable on the bowstrings is an arrow propelling element 50 which is slid to the position shown in FIG. 4 when one wishes to utilize the apparatus to propel an arrow. In this position the propelling element 50 is located behind the bow segment connector 16.

Arrow propelling element 50 includes an elongated segment 52 which may manually be grasped by the archer as shown in FIG. 4. Segment 52 is received in the notch conventionally employed at the end of the arrow so that the arrow is centered between the bowstrings 40, 42. The arrow propelling element 50 also includes two spaced rings 54, 56 which extend laterally from the segment 52 and encompass the bowstrings 40, 42, it being understood that the dimensions of the rings 54, 56 internally are somewhat less than the distance normally between the bowstrings so that the bowstrings are flexed slightly toward one another and frictional engagement is maintained between the arrow propelling element 50 and the bowstrings.

As indicated above, the apparatus may readily be employed to propel projectiles other than arrows. If desired, the arrow support 20 can be removed from the bow segment connector when one wishes to do this.

In the arrangement illustrated, three different propelling elements are deployed along the bowstrings other than arrow propelling element 50 for the purpose of propelling rocks and similar types of projectiles. These three propelling elements are designated by reference numerals 60, 62 and 64. Propelling elements 60, 62 and 64 are essentially of identical construction, the only difference being size. Each propelling element 60, 62, 64 is in the form of a rectangular-shaped band of flexible sheet material. For example, such material may be cloth, leather, plastic sheet or the like. Each of the propelling elements 60, 62, 64 curves outwardly away from the bowstrings to define a receptacle for a projectile.

One wishing to utilize one of the propelling elements 60, 62, 64 merely slides the selected propelling element behind the bow segment connector, it being understood of course that the arrow propelling element 50 has previously been slid from such position. The receptacle provided by propelling element 60 is somewhat larger than that provided by the other two propelling elements employed to propel projectiles that are not arrows. Propelling element 64 is utilized to propel the smallest projectiles.

A manually graspable handle is located on bow segment 14 immediately below bow segment connector 16, the handle being designated by reference numeral 70.

I claim:

1. Apparatus for propelling projectiles, said apparatus comprising, in combination:

an elongated, flexible bow member having opposed ends;

a first bowstring attached to said bow member and extending under tension between the opposed ends of said bow member;

a second bowstring attached to said bow member and extending under tension between the opposed ends of said bow member, said first and second bowstrings being spaced apart between the opposed ends of said bow member; and at least one manually graspable propelling element extending between said bowstrings for engaging a projectile and propelling said projectile away from said bow member.

2. The apparatus according to claim 1 wherein said manually graspable propelling element frictionally engages both of said bowstrings and is slidably movable relative to said bowstrings to allow said manually graspable propelling element to be selectively positioned at different locations along said bowstrings.

3. The apparatus according to claim 1 including a plurality of manually graspable propelling elements extending between said bowstrings.

4. The apparatus according to claim 3 wherein said manually graspable propelling elements frictionally engage both of said bowstrings and are slidably movable relative to said bowstrings to allow said manually graspable propelling elements to be selectively positioned at different locations along said bowstrings.

5. The apparatus according to claim 1 wherein said bow member includes a first flexible elongated bow segment, a second flexible elongated bow segment, and a bow segment connector between said bow segments and attached to said bow segments, said bow segment connector defining an opening allowing passage between said bow segments of a projectile propelled away from said bow member by said manually graspable propelling element.

6. The apparatus according to claim 5 wherein said bow segment connector includes a continuous connector wall extending about and defining said opening.

7. The apparatus according to claim 5 additionally comprising an arrow support connected to said bow segment connector and extending into said opening for slidably supporting the shaft of an arrow.

8. The apparatus according to claim 1 wherein said manually graspable propelling element comprises a flexible member curving outwardly from said first and second bowstrings and defining a receptacle for a projectile.

9. The apparatus according to claim 1 wherein said manually graspable propelling element includes a propelling element segment receivable in the notched end of an arrow and spaced connector members connected to said propelling element segment and in slidable, frictional engagement with said first and second bowstrings.

10. The apparatus according to claim 9 wherein said connector members are rings encompassing said first and second bowstrings.

11. The apparatus according to claim 1 wherein the ends of said bow member define recesses, said first and second bowstrings each comprising portions of a continuous bowstring loop positioned in said recesses.

12. The apparatus according to claim 1 wherein said bow member defines an opening generally midway between the opposed ends of said bow member for allowing the passage through said bow element of projectiles propelled by said manually graspable propelling element.

13. The apparatus according to claim 12 including a plurality of manually graspable propelling elements extending between said bowstrings, said manually graspable propelling elements being moveable lengthwise along said bowstrings to selectively alternatively position said manually graspable propelling elements behind said opening.

14. The apparatus according to claim 13 additionally comprising a manually graspable handle on said bow member closely adjacent to said opening.

15. The apparatus according to claim 1 wherein said first and second bowstrings are substantially parallel.

* * * * *